United States Patent [19]

Elf

[11] 4,428,514

[45] Jan. 31, 1984

[54] INFANT CARRIER

[76] Inventor: Jennifer L. Elf, 1103 A St., Ellensburg, Wash. 98926

[21] Appl. No.: 330,124

[22] Filed: Dec. 14, 1981

[51] Int. Cl.[3] ..... A47D 13/02; A47C 31/00

[52] U.S. Cl. ..... 224/151; 224/155; 224/160; 297/118; 297/465; 297/467

[58] Field of Search ..... 224/153, 154, 155, 156, 224/158, 159, 160, 161, 901, 151; D3/31, 32; 297/118, 465, 467

[56] References Cited

U.S. PATENT DOCUMENTS

| | | | |
|---|---|---|---|
| 278,437 | 5/1883 | Lancaster . | |
| 2,599,474 | 6/1952 | Mills | 224/6 |
| 3,197,100 | 7/1965 | Thompson | 224/6 |
| 3,229,873 | 1/1966 | Hershman | 224/6 |
| 3,327,914 | 6/1967 | Abram | 224/901 |
| 3,331,540 | 7/1967 | Higuchi | 224/6 |
| 3,481,517 | 12/1969 | Aukerman | 224/6 |
| 3,780,919 | 12/1973 | Hansson | 224/6 |
| 3,871,562 | 3/1975 | Grenier | 224/6 |
| 4,009,808 | 3/1977 | Sharp | 224/6 |
| 4,037,764 | 7/1977 | Almosnino et al. | 224/6 |
| 4,149,687 | 4/1979 | Nunemacher | 224/159 |
| 4,234,229 | 11/1980 | Arnold | 224/160 |
| 4,271,998 | 6/1981 | Ruggiano | 224/160 |

FOREIGN PATENT DOCUMENTS

| | | | |
|---|---|---|---|
| 123094 | 6/1944 | Australia | 224/161 |
| 907687 | 10/1962 | United Kingdom | 224/160 |

*Primary Examiner*—Allan N. Shoap
*Assistant Examiner*—David Fidei
*Attorney, Agent, or Firm*—Ward Brown; Robert W. Beach

[57] ABSTRACT

Long shoulder straps have corresponding ends secured to a length of fabric and extend from one of its ends. The free ends of the long straps are connectible to the length at its other end or, optionally, generally midway between its ends so as to form closed loops for mounting the carrier on the shoulders of a user. In a preferred carrying position, shorter straps extend generally between the ends of the fabric length to maintain it in return looped condition forming a seat for an infant to be carried in sitting position. Different connections of the straps to the fabric length can be used for other carrying positions.

10 Claims, 12 Drawing Figures

INFANT CARRIER

BACKGROUND OF THE INVENTION

1. Field of the Invention

The present invention relates to an infant carrier of the type designed principally for transporting an infant in upright or sitting position and having shoulder straps for mounting the carrier on an intended user.

2. Prior Art

One type of known infant carrier includes an upright box frame supporting a fabric seat for an infant. Shoulder straps have their opposite ends connected, respectively, at the top and bottom of the frame for mounting the frame on the user, much like a rigid frame backpack.

In another type of known infant carrier no rigid frame is provided. Rather, the infant is fitted through the open end of a fabric bag with a flexible seat at or near its bottom. The legs of the infant may project through laterally spaced holes toward the bottom of the bag. Shoulder straps are connected at laterally spaced locations toward the top and bottom of the bag, and the infant may be carried at the front of the user.

With the known infant carriers it may be difficult to fit the infant in the carrier and then mount the carrier on the intended user, or it may be difficult to mount the carrier on the intended user and then fit the infant in the carrier. In addition, the known carriers are designed for one specific carrying position which may become awkward or tiresome for the infant or the user after the infant is carried for a substantial period. Further, a specific carrying position may be appropriate and comfortable for the infant and the user for a given weight or development of the infant, but may be inappropriate as the infant increases in weight, physical ability or activity level.

SUMMARY OF THE INVENTION

It is an object of the present invention to provide an infant carrier usable for carrying an infant in a variety of different positions.

It also is an object to provide such a carrier which is comfortable for the user and enjoyable for the infant at various stages of development of the infant.

A further object is to provide such a carrier which is of simple, inexpensive, yet sturdy, construction and easy to use.

Another object is to provide such a carrier which may be folded compactly when not in use.

Still another object is to provide such a carrier which may be adjusted to accommodate different sizes of users and infants.

The foregoing objects can be accomplished by providing an infant carrier including a length of flexible material, a set of long shoulder straps connected to the length so as to form closed loops enabling the carrier to be mounted on an intended user, and shorter straps which, in a preferred carrying position, extend generally between the opposite ends of the length to maintain it in return looped position forming a cavity for receiving the infant to be carried.

In the preferred embodiment, corresponding ends of the long shoulder straps are secured to the length, extend generally lengthwise away from an end thereof and have free ends which can be connected alternatively to connectors carried generally centrally of the length or connectors carried at the other end of the length. The short straps have corresponding ends secured to the longer straps and free ends connectible to the length by use of the connectors. Various interconnections can be used to provide different carrying positions for the infant, including a sitting position facing outward from the front of the user or in which the carrier is mounted on a chair, a sitting position facing inward toward the front of the user, a sitting position resting on the user's hip and a lying position in which the carrier forms a sling.

DETAILED DESCRIPTION

Figure 1:
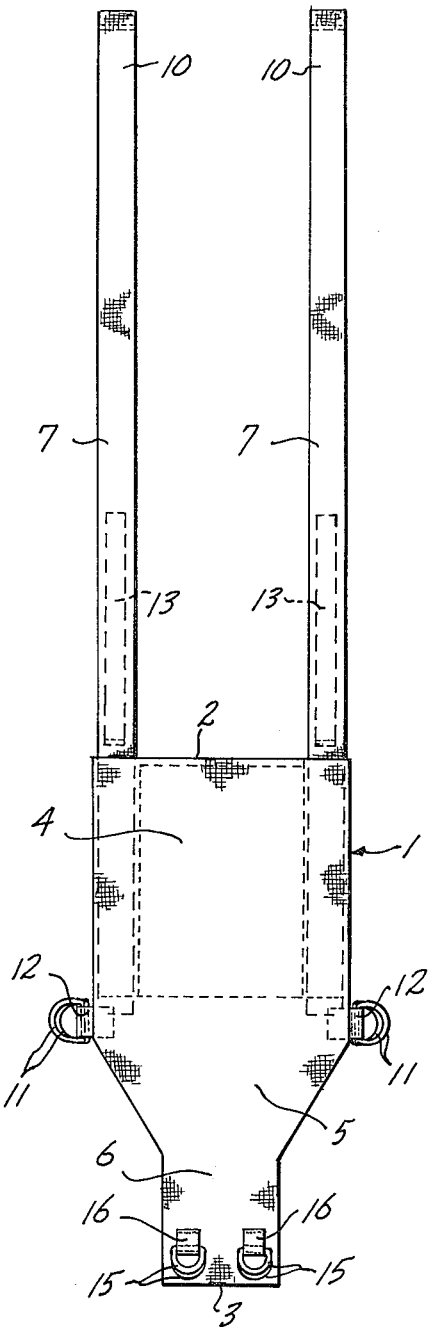
FIG. 1 is a top plan of an infant carrier in accordance with the present invention.
Figure 2:
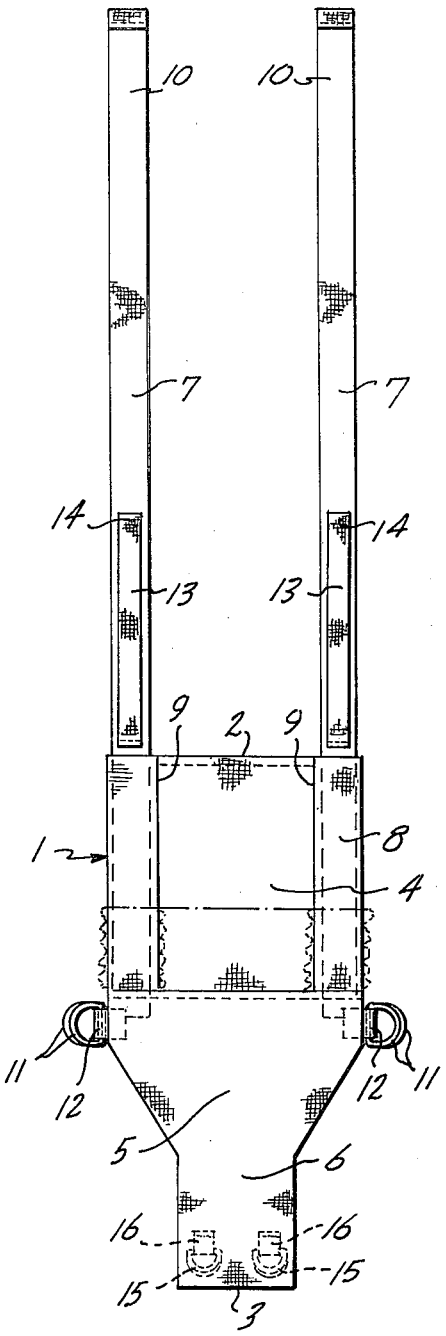
FIG. 2 is a bottom plan thereof.

As shown in FIGS. 1 and 2, the preferred embodiment of an infant carrier in accordance with the present invention includes an elongated length 1 of flexible material, such as fabric, having a "back" end 2 and a "bib" end 3. Between the back and bib ends the flexible or fabric length includes the generally rectangular back end portion 4, preferably of a width equal to or somewhat wider than the infant or toddler to be carried, a central or "seat" portion 5, preferably decreasing in width from the back end portion toward the bib end of the length, and the generally rectangular bib end portion 6 which, preferably, is of a width approximately equal to or somewhat narrower than the infant or toddler to be carried.

Each of a pair of laterally spaced flexible shoulder straps 7 extends generally lengthwise away from the back end 2 of the fabric length 1. Corresponding ends of such straps are sewn to the fabric length at generally the junction of the back end portion 4 and the seat portion 5. As best seen in FIG. 2, the opposite lateral margins 8 of the back end portion 4 are folded over the straps and sewn at their inner sides 9 to the back end portion between the straps, enabling adjustment of the longitudinal height of the back end portion by sliding the back end lengthwise over the straps and ruffling the folded over margins 8 as indicated in broken lines in FIG. 2.

In most uses of the carrier the free end portions 10 of the long shoulder straps 7 are connected to the fabric length at the base of its back end portion 4. For this purpose, suitable connectors, such as pairs of rings 11, are secured at the opposite lateral sides of the fabric length. Fabric loops 12 extend through the rings and are sewn to the fabric length.

In addition to the shoulder straps 7 which are provided for mounting the carrier on a user, also provided are shorter shoulder straps 13 for the infant. As best seen in FIG. 2, preferably one end portion of each short strap 13 is sewn to one of the longer straps 7 at a location slightly above the back end 2 of the fabric length in unruffled condition. In most uses of the carrier the free end portions 14 of the short straps 13 are connected to the fabric length at approximately its bib end 3 and for this purpose suitable connectors, namely, pairs of rings 15, are secured to the bib end portion by fabric loops 16 extending through the rings and sewn to the bib end portion.

Figure 4:
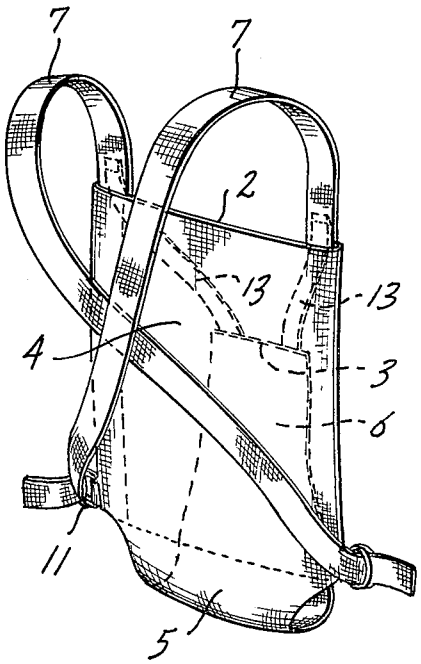
FIG. 4 is a top rear perspective of the carrier in the same position.
Figure 3:
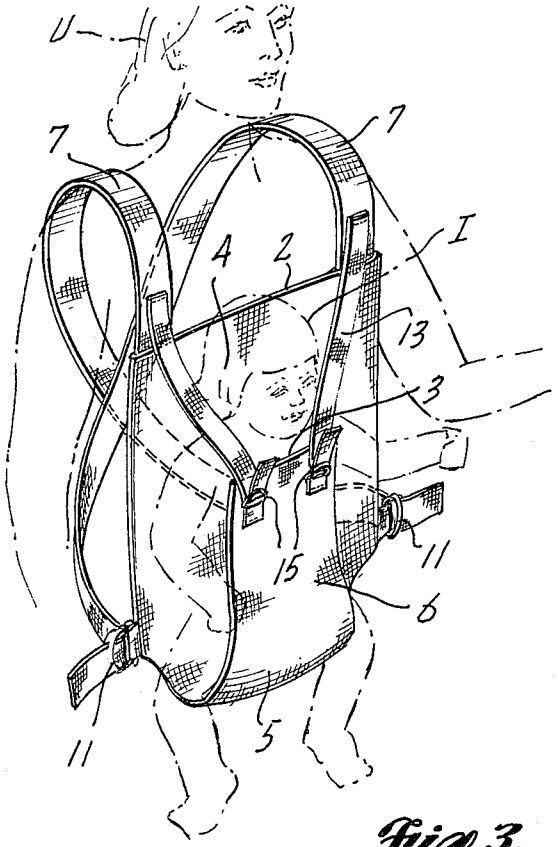
FIG. 3 is a somewhat diagrammatic top front perspective of the carrier of FIG. 1 interconnected for one carrying position, with a user and an infant indicated in broken lines.

In one carrying position, the "baby facing out" position indicated in FIGS. 3 and 4, the carrier is mounted on an adult user U by looping the long straps 7 over the user's shoulders, crossing the straps behind the user's back and attaching the free end portions of the straps, respectively, to the pairs of attachment rings 11 at the opposite lateral sides of the base of the back end portion. In this position the back end portion of the fabric length lies flat against the front of the user. The free ends of the short straps 13 are connected to the rings 15 toward the bib end 3 of the fabric length which is looped downward forming a seat for the infant I who faces outward or forward with his or her legs straddling the seat portion of the carrier. The head of the infant is received between the short infant shoulder straps 13 which extend across the ends of the fabric length. The arms of the user are free and the infant has an interesting view of all that is occurring.

Figure 5:
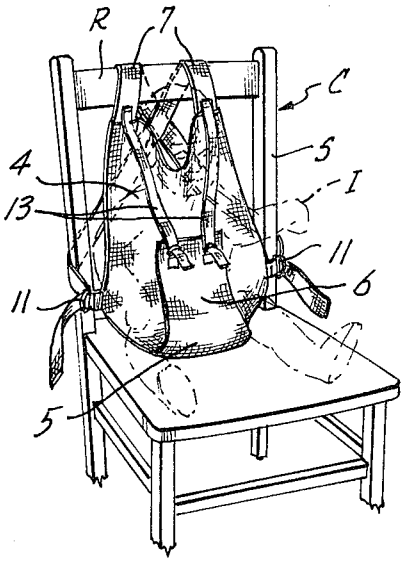
FIG. 5 is a somewhat diagrammatic top front perspective of the carrier of FIG. 1 illustrating another use for the carrier when in substantially the same condition as that shown in FIG. 3, with an infant indicated in broken lines.

As indicated in FIG. 5, the same connections of the straps 7 and 13 may be used for supporting the infant on a high backed chair C. The straps 7 extend over the top rung R of the chair and are crossed behind the back of the chair and around its sides S to the attachment rings 11. The back end portion of the fabric length rests against the back of the chair; the seat portion lies on the seat of the chair; and the bib end portion rests against the front of the infant.

Figure 8:
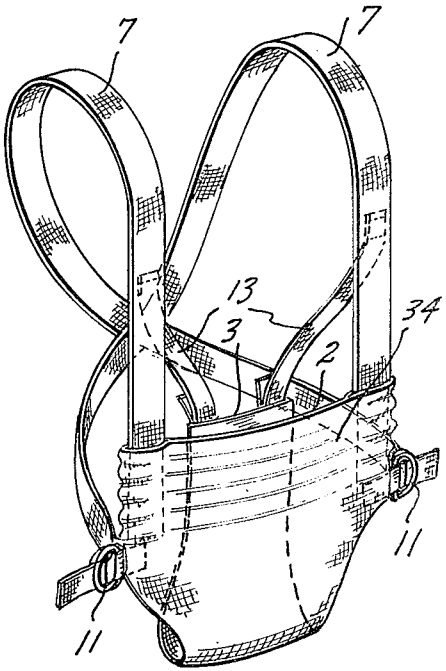
FIG. 8 is a top front perspective of the carrier, corresponding to FIG. 6, with parts in different positions.
Figure 7:
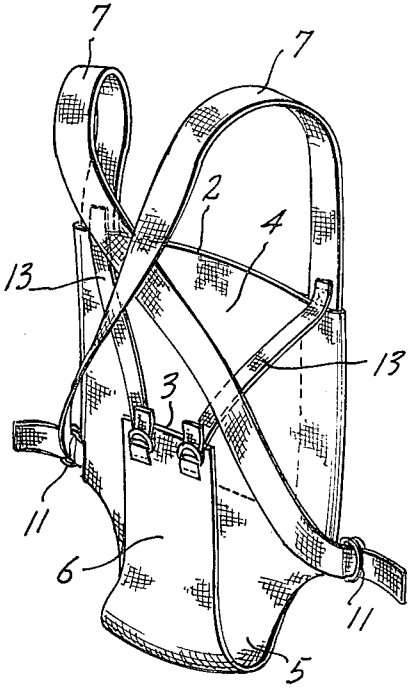
FIG. 7 is a top rear perspective of the carrier in the same position.
Figure 6:
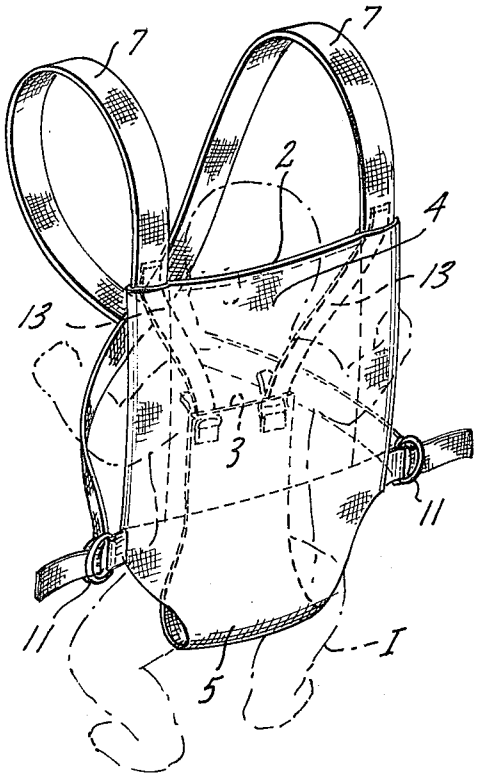
FIG. 6 is a somewhat diagrammatic top front perspective of the carrier of FIG. 1 interconnected for an alternative carrying position, with an infant indicated in broken lines.

In the "baby faces in" position indicated in FIGS. 6, 7 and 8, the connections of the straps 7 and 13 are the same as for the positions shown in FIGS. 3, 4 and 5. The long shoulder straps 7 extend upward from the back end of the fabric length, are looped over a user's shoulders and behind his or her back to their connections at the rings 11. The short straps 13 are connected to the bib end portion 6 at its rings 15. In the position of FIGS. 6, 7 and 8, however, the bib end portion is looped inward toward the user and the infant conveniently rests on the seat portion 5 facing inward toward the chest of the user, which is a comfortable secure position for sleeping. For infants so young that their neck muscles are incapable of sturdily supporting the full weight of the infant's head, the back end portion can be left fully extended as shown in FIGS. 6 and 7 such that the back end portion of the carrier engages the back of the infant's head. For more developed infants or toddlers, the back end portion can be ruffled downward to a desired height, as indicated in FIG. 8, such that it engages only the back or the back and the neck of the carried infant or toddler.

Figure 10:
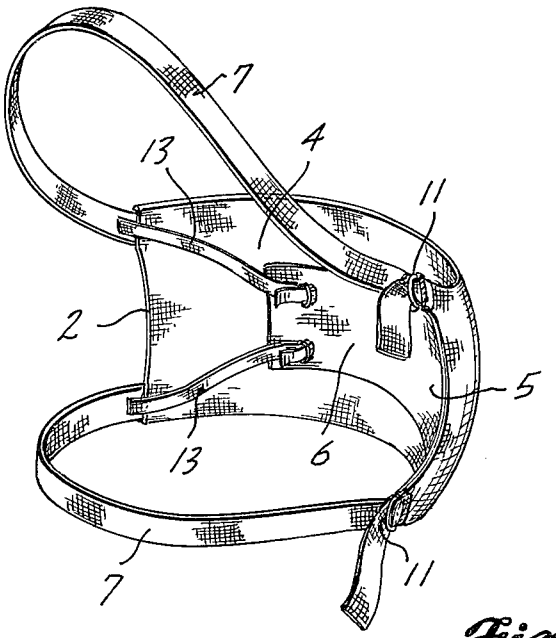
FIG. 10 is a top rear perspective of the carrier in the same position.
Figure 9:
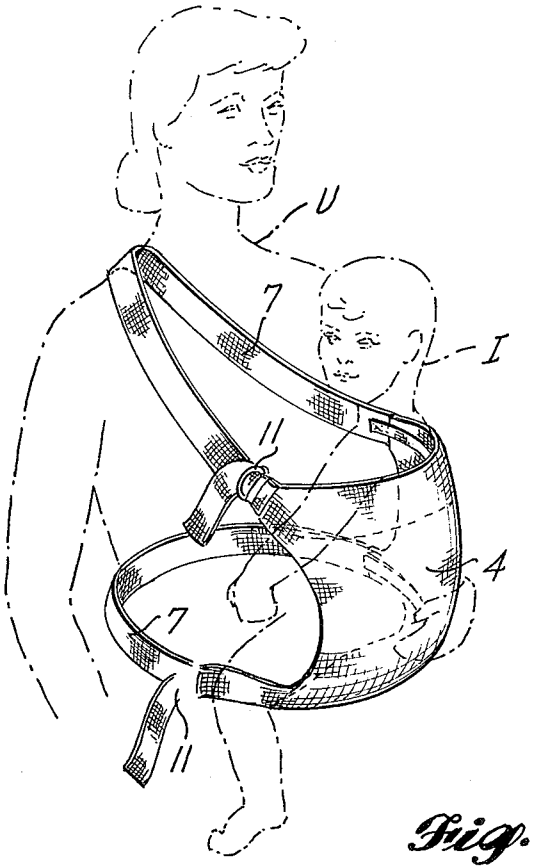
FIG. 9 is a somewhat diagrammatic top front perspective of the carrier of FIG. 1 interconnected for another carrying position, with the user and infant indicated in broken lines.

For the "hip" position illustrated in FIGS. 9 and 10, again the long straps 7 are connected to the intermediate rings 11 and the short straps 13 are connected to the bib end rings 15. In this instance, however, the long straps are not crossed but rather each strap is connected to the pair of rings 11 at the same side of the carrier as the side of its attachment at the base of the back end portion 4. In addition, the bib end portion 6 and the seat portion 5 are folded against the back end portion 4 such that the infant or toddler is not engaged between the back end portion and the bib end portion. As indicated in FIG. 9, the carrier is turned sideways with the lower long strap 7 encircling the waist of the user U to the lower pair of rings 11. The upper long strap extends from the back end 2 of the carrier beneath one arm of the user and over the opposing shoulder to the upper pair of rings 11. In this position the length of the carrier extends generally horizontally around one hip of the user and, with the lower strap 7 pulled tight, the lower marginal portion of the fabric length forms a narrow seat for the infant I. The infant is placed in the carrier with his or her legs straddling the opposite end portions of the lower strap 7 and his or her head projecting upward through the loop of the upper long shoulder strap. Substantially the full weight of the infant or toddler rests on the hip and shoulder of the user but the toddler still should be balanced with the user's arm at the same side.

In an alternative "hip" position, the lower long strap can be wrapped over the shoulder of the user at the side opposite the infant-supporting hip along with the upper long shoulder strap, rather than being wrapped around the user's waist, forming a sling with a narrow seat for the infant. Nevertheless, as with the position shown in FIGS. 9 and 10, the infant or toddler should be balanced with the user's arm at the side of the weight-bearing hip.

Figure 12:
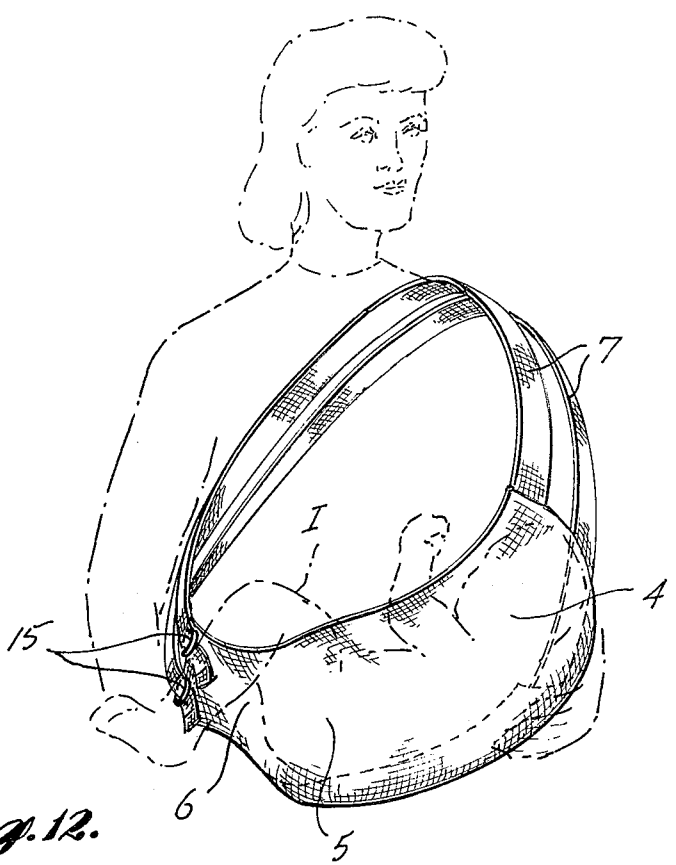
FIG. 12 is a somewhat diagrammatic front perspective of the carrier in the same position, with a user and an infant indicated in broken lines.
Figure 11:
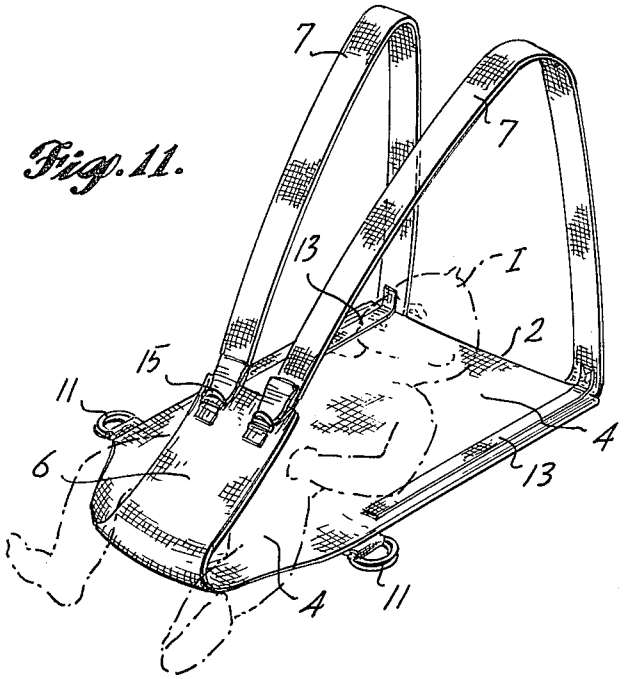
FIG. 11 is a somewhat diagrammatic top front perspective of the carrier of FIG. 1 interconnected for still another carrying position, with an infant indicated in broken lines.

In the "cradle" position indicated in FIGS. 11 and 12, the short shoulder straps are left loose and the free end portions of the long shoulder straps 7 are connected to the rings 15 at the bib end portion of the carrier to form a sling for the infant which, as indicated in FIG. 11, may be laid face up in the sling with his or her legs straddling the seat portion 4. As indicated in FIG. 12, the infant may be supported in the sling at the front of the user with the straps 7 looped over one shoulder, around the back and under the opposing shoulder of the user. This position is convenient for nursing with the user seated or standing, or for a sleeping newborn.

In the preferred embodiment of the invention the fabric length is about 28 inches (71 cm) long; the rectangular bib end portion is about 8 inches (20 cm) long and about 6 inches (15 cm) wide; the rectangular back end portion is about 14 inches (36 cm) long and about 13 inches (33 cm) wide; and the seat portion constitutes the remainder of the length and flares in width from the bib end portion to the back end portion. All positions shown in the drawings can be accommodated for most adults and infants and toddlers to about 30 pounds (14 kg) if the long straps extend about 36 inches (91 cm) beyond the back end of the fabric length and the short straps extend about 13 inches (33 cm) from the long straps. The lengths of the straps are adjustable to fit users and infants of different sizes, and the flexible carrier can be folded or rolled into compact condition when not in use.

I claim:

1. A convertible seat and cradle carrier for an infant having a sheet body including a back panel, a bib panel and a seat panel connecting the back panel and the bib panel, first two disengageable connection means carried by opposte sides of the body, respectively, adjacent to the junction of the back panel and the seat panel and two supporting straps each having one end secured permanently to the body and a free end, the improvement comprising the back panel, the bib panel and the seat panel being disposable in coplanar relationship to form the body as a flat sheet, spanning strap means carried by said supporting straps and connectible with the edge portion of the bib panel remote from the seat panel to form the sheet body as a return bent pouch with the free ends of the supporting straps secured, respectively, to the first two disengageable connection means to carry the weight of the pouch and an infant therein, and second two disengageable connecting means carried by a portion of the bib panel remote from the seat panel and connectible, respectively, to the free ends of the two supporting straps to form and support the sheet body as a sling for carrying an infant in reclining position wherein said spanning strap means are in a nonuse position.

2. A carrier for an infant and mountable on an intended user comprising a length of flexible material having a back end portion, a bib end portion and a central portion therebetween, two elongated flexible first straps extending from one end portion of said length, first attachment means carried by the other end portion of said length, second attachment means carried by said central portion of said length, said first straps having free end portions connectible alternatively to either of said first and second attachment means such that said two first straps, in combination with said length, form closed shoulder loops for mounting the carrier on the intended user, and two elongated flexible second straps connectible to said length so as to extend generally across the opposite ends of said length to form, in combination with said length, closed loops defining a cavity for receiving the infant.

3. The carrier defined in claim 2, in which the first straps have end portions secured to the flexible length and the second straps have end portions secured, respectively, to the first straps.

4. The carrier defined in claim 2, in which the first straps extend generally longitudinally away from the back end portion of the length.

5. The carrier defined in claim 4, in which the first attachment means is carried by the bib end portion of the length, and the free end portions of the first straps are connectible to the first attachment means in a first carrying position and to the second attachment means in a second carrying position.

6. The carrier defined in claim 4, in which the first straps are secured to the length intermediate the ends of the length and the back end portion of the length has opposite lateral marginal portions encircling the first straps, respectively, enabling adjustment of the effective length of the back end portion relative to the first straps by sliding the back end portion of the length along the first straps.

7. The carrier defined in claim 2, in which the bib end portion of the length is narrower than the back end portion of the length.

8. The carrier defined in claim 7, in which the central portion of the length flares from the bib end portion to the back end portion.

9. The carrier defined in claim 2, in which the straps are of adjustable length.

10. A carrier for an infant and mountable on an intended user comprising a length of flexible material having a back end portion, a bib end portion and a central portion therebetween, two elongated flexible first straps each having one end portion secured to said length intermediate the ends of said length, said back end portion of said length having opposite lateral marginal portions encircling said first straps, respectively, so that said first straps extend longitudinally away from said back end portion and so that the effective length of said back end portion can be adjusted relative to said first straps by sliding said back end portion along said first straps, each of said first straps further having a free end portion connectible to a portion of said length such that said two first straps, in combination with said length, form closed shoulder loops for mounting the carrier on the intended user, and two elongated flexible second straps connectible to said length so as to extend generally across the opposite ends of said length to form, in combination with said length, closed loops defining a cavity for receiving the infant.

* * * * *